US006892503B1

(12) United States Patent
Kang

(10) Patent No.: US 6,892,503 B1
(45) Date of Patent: May 17, 2005

(54) LONG SPAN CANOPY FRAME CONNECTORS

(76) Inventor: Ho Sang Kang, Wonlim International 14350-300 Garfield Ave., Paramount, CA (US) 90723

( * ) Notice: Subject to any disclaimer, the term of this patent is extended or adjusted under 35 U.S.C. 154(b) by 76 days.

(21) Appl. No.: 10/314,465

(22) Filed: Dec. 9, 2002

(51) Int. Cl.[7] ..... E04H 15/34

(52) U.S. Cl. ..... 52/653.2; 52/655.1; 403/170; 403/171

(58) Field of Search ..... 52/655.1, 653.2; 403/169, 170, 171, 177, 214; 135/122, 909

(56) References Cited

U.S. PATENT DOCUMENTS

| | | | | | |
|---|---|---|---|---|---|
| 413,730 | A | * | 10/1889 | Palmer | 135/160 |
| 998,904 | A | * | 7/1911 | Jacobs | 285/383 |
| 1,347,808 | A | * | 7/1920 | Franklin | 403/119 |
| 2,001,215 | A | * | 5/1935 | Ruppel | 52/653.2 |
| 2,149,844 | A | * | 3/1939 | George | 403/178 |
| 3,424,178 | A | * | 1/1969 | Yoshimi | 135/157 |
| 4,056,327 | A | * | 11/1977 | Daus et al. | 470/172 |
| 4,838,003 | A | | 6/1989 | Zeigler | |
| 5,224,320 | A | | 7/1993 | Mai | |
| 5,700,102 | A | | 12/1997 | Feleppa | |
| 5,709,238 | A | * | 1/1998 | Mattioli | 135/87 |
| 5,966,890 | A | * | 10/1999 | Inman | 52/653.2 |
| 6,000,175 | A | * | 12/1999 | Gale et al. | 52/63 |
| 6,112,757 | A | | 9/2000 | Tseng | |
| 6,173,726 | B1 | * | 1/2001 | Talmadge | 135/144 |
| 6,618,988 | B2 | * | 9/2003 | Williams et al. | 47/17 |

* cited by examiner

*Primary Examiner*—Brian E. Glessner
*Assistant Examiner*—Basil Katcheves
(74) *Attorney, Agent, or Firm*—Alvin S. Blum

(57) ABSTRACT

A frame for supporting a fabric canopy or tent is formed from a number of elongate rigid cylindrical elements, tubes or rods, joined by a variety of special connectors. They form a frame of interconnected rigid trusses. Each truss has an upper chord and a spaced-apart lower chord connected by rigid members therebetween to form trusses with sufficient rigidity to span greater unsupported spans than conventional canopy frames. Each connector has a plurality of tubular receptacles for receiving the cylindrical elements and transverse threaded apertures for threaded locking fasteners for securing the cylindrical elements in place.

17 Claims, 5 Drawing Sheets

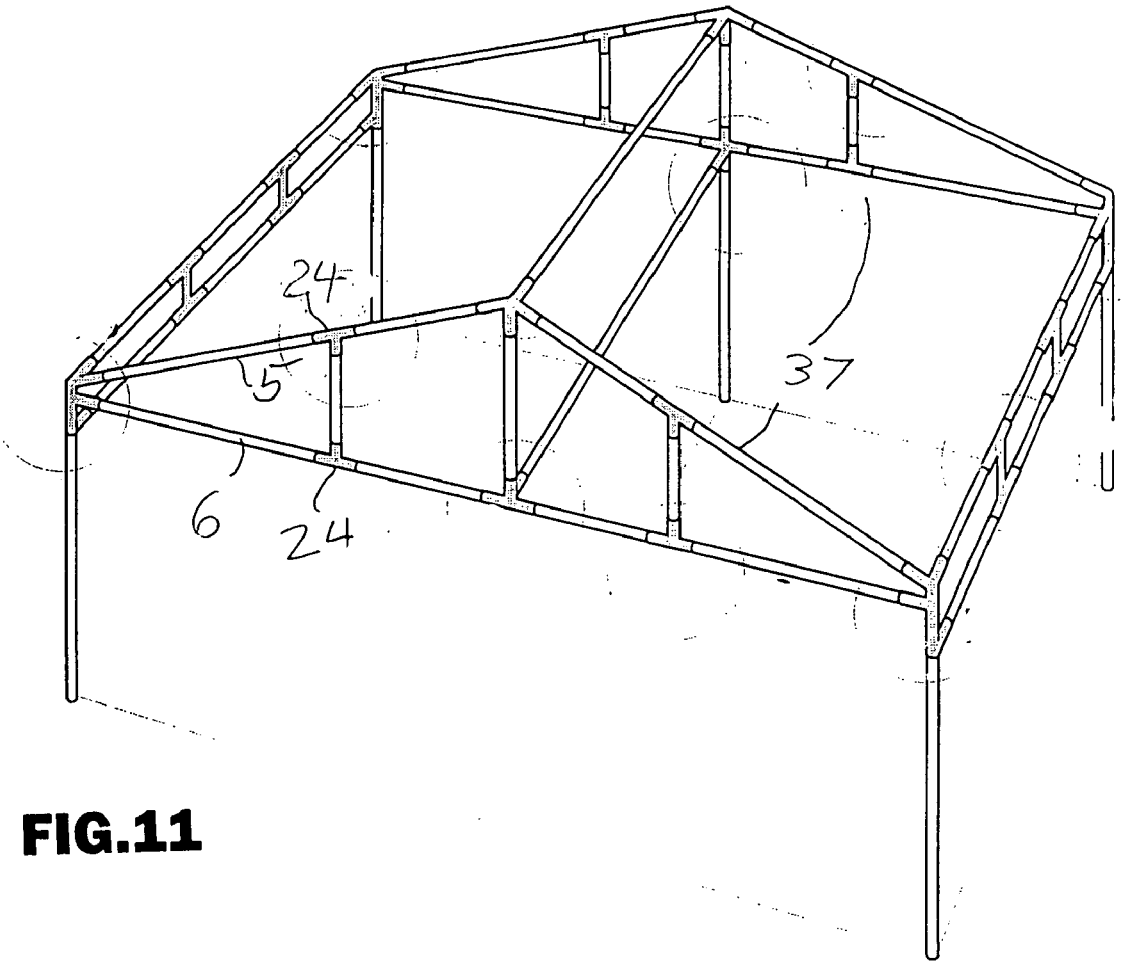
FIG.11
FIG. 9
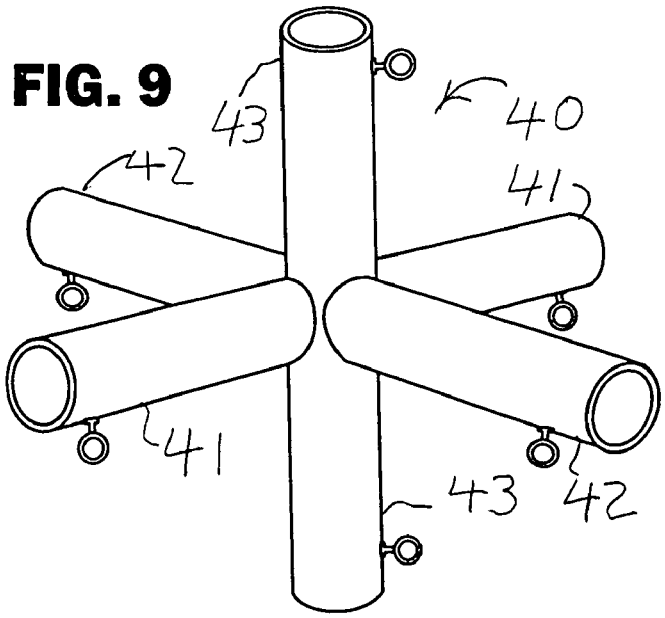

LONG SPAN CANOPY FRAME CONNECTORS

This invention relates to frames for canopies, and more particularly to connectors for long tubes or rods for those frames enabling stable structures with long spans unsupported by vertical members.

BACKGROUND OF THE INVENTION

Frames for supporting fabric canopies or tents are well known in the art. It is common practice to assemble such frames from sections of elongate tubes or rods that are held together in proper configuration by a variety of connectors, such as disclosed in U.S. Pat. No. 5,700,102 issued Dec. 23, 1997 to Feleppa. Such frames support a fabric roof by vertical corner members. If the distance between corners is greater than about twelve feet, one or more additional vertical support members is required between the corners to provide adequate support to the span. There are many situations where it would be desirable to provide an unsupported span much greater than 12 feet, such as providing greater access to the contents of the tent or canopy.

SUMMARY OF THE INVENTION

It is accordingly an object of the invention to provide connectors for a canopy or tent frame that will enable structures with unsupported spans up to twice the conventional distance of such frames. The connectors of the invention, in combination with the elongate pipes or rods, provides a frame with a plurality of interconnected trusses. Each truss having an upper chord and a lower chord connected by rigid members therebetween to provide trusses with sufficient rigidity to span greater unsupported distances than the single chords of conventional frames. These and other objects, features, and advantages of the invention will become more apparent when the detailed description is studied in conjunction with the drawings in which like elements are designated by like reference characters in the various drawing figures.

BRIEF DESCRIPTION OF THE DRAWINGS

FIG. 9 is a perspective view of a three-way connector of the invention.

FIG. 11 is a perspective diagrammatic view of another embodiment of the invention.

DETAILED DESCRIPTION OF PREFERRED EMBODIMENTS

Figure 1:
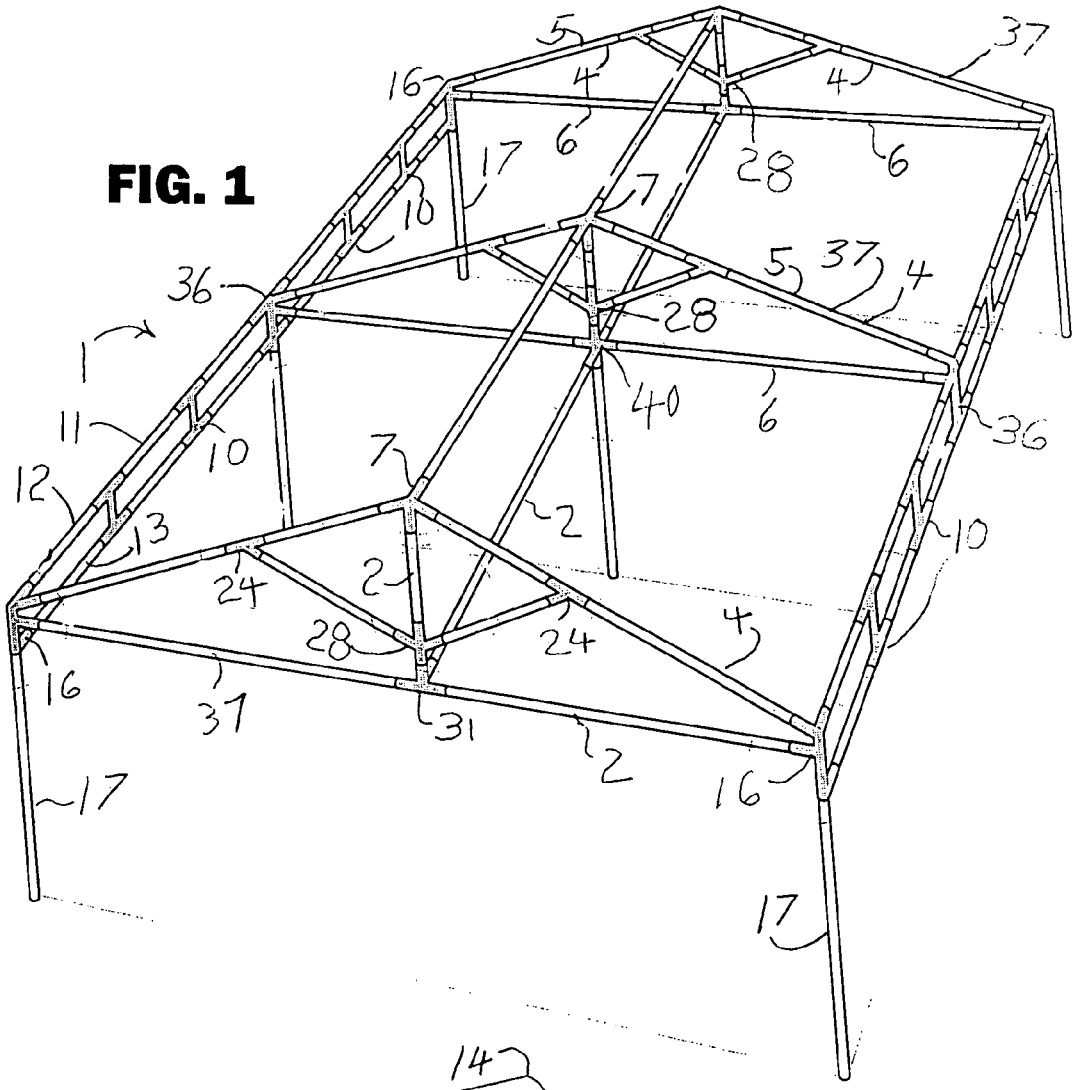
FIG. 1 is a perspective view of a frame of the invention.
Figure 3:
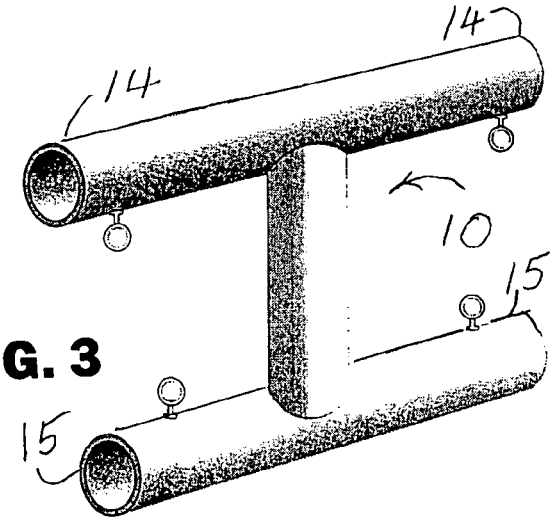
FIG. 3 is a perspective view of an H connector of the invention.
Figure 4:
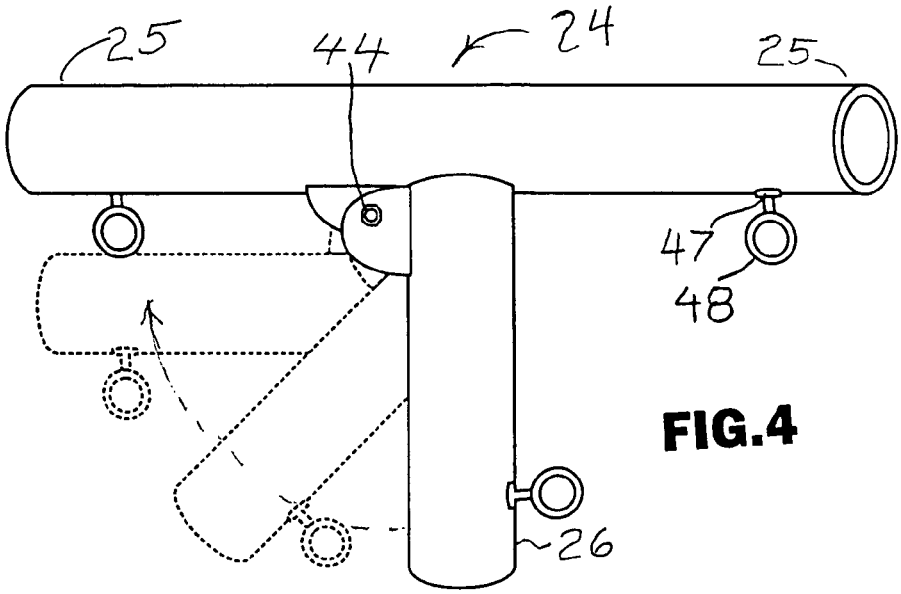
FIG. 4 is a perspective view of a T connector of the invention.
Figure 2:
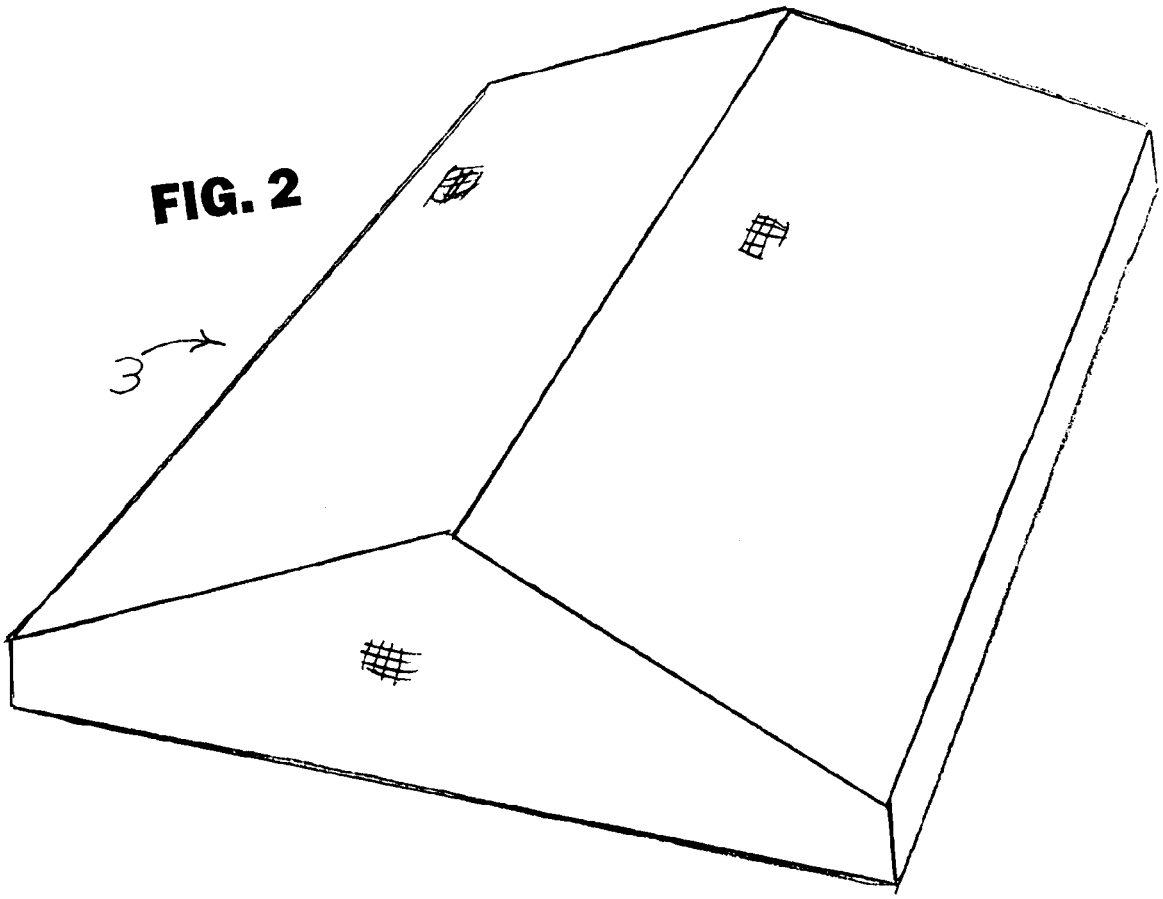
FIG. 2 is a perspective view of a fabric canopy cover for mounting on the frame of FIG. 1.
Figure 6:
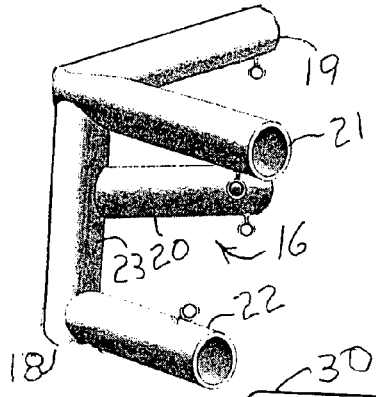
FIG. 6 is a perspective view of a corner connector of the invention.
Figure 5:
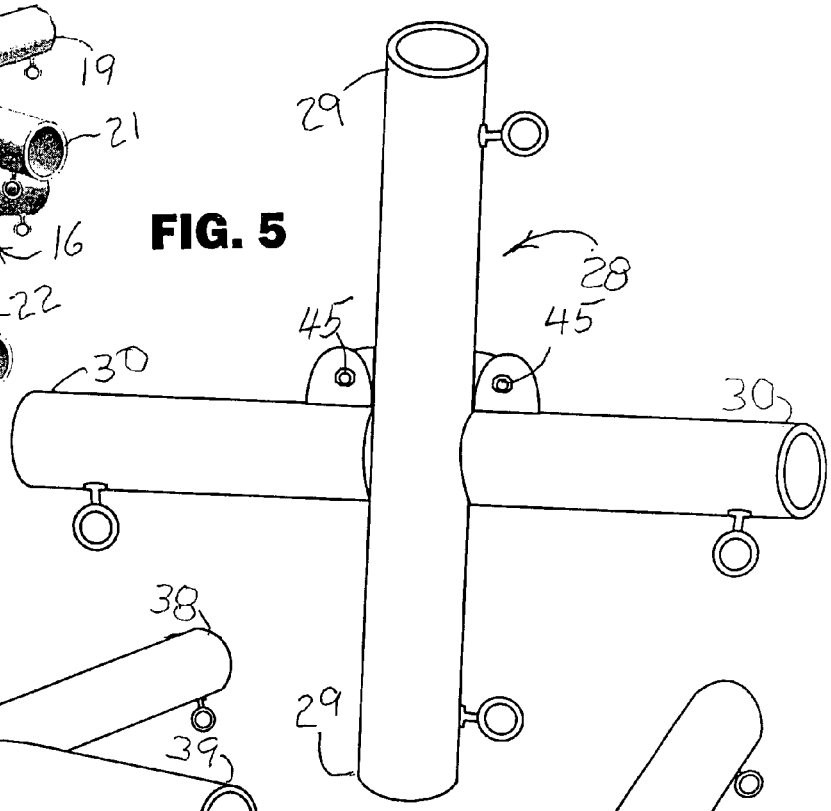
FIG. 5 is a front elevation view of a cross connector of the invention.
Figure 8:
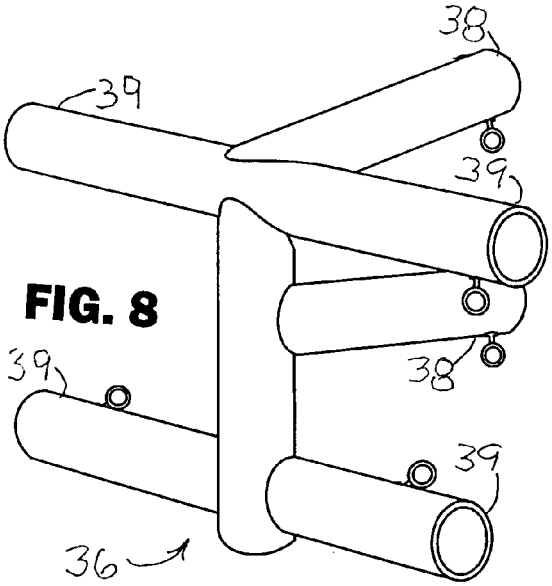
FIG. 8 is a perspective view of a two-truss connector of the invention.
Figure 7:
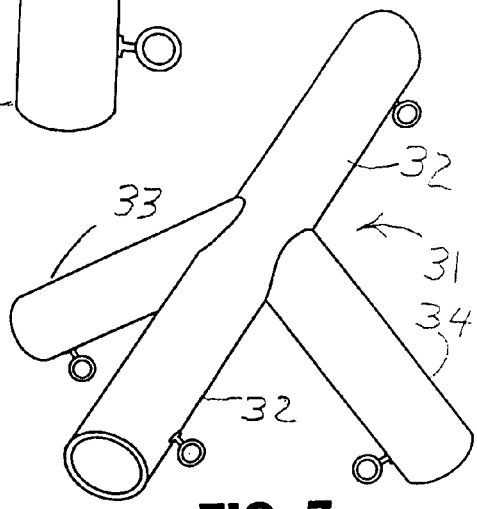
FIG. 7 is a perspective view of a 2-way connector of the invention.

Referring now to the drawing FIGS. 1–10, a plurality of elongate rigid cylindrical elements 2, such as tubes or rods, are joined together by the plurality of special connectors having tubular receptacles for receiving therein the cylindrical elements 2 to form a rigid frame 1 with vertical corner posts 17 to support thereon a fabric canopy or tent 3 (FIG. 2). Threaded apertures 47 positioned transverse to each tubular receptacle receive threaded locking devices such as eyebolt 48 to secure the element 2 in place. The frame is composed of a plurality of interconnected trusses, each having an upper element for supporting contact with the fabric underside, a spaced apart lower chord, and at least one stiffening member connected between the lower chord and the upper element intermediate their ends. This construction enables the frame to span greater unsupported distances and enhances structural strength. Each sloping truss 37 has a straight lower chord 6 and a spaced apart sloping upper element 5 formed of sloping elongate members 4 joined by peak connector 7 (FIG. 10) having tubular receptacles 8 oriented at an obtuse angle for receiving members 4. A receptacle 9 in connector 7 receives a downwardly directed stiffening cylindrical element 2 that is connected to receptacle 33 of 2-way connector 31 (FIG. 7). In addition at least one lateral receptacle 46 orthogonal to the common plane of the other receptacles of connector 7 serves to connect a truss 37 to the peak of one or more adjacent trusses 37.

Two in-line receptacles 32 of 2-way connector 31 receive the lower chord 6 intermediate the ends thereof. Receptacle 34 of connector 31 orthogonal to chord 6 receives an element 2 joining to a lower chord of an adjacent truss 37.

The ends of lower chord 6 of truss 37 are joined to the ends of the upper element 5 by corner connectors 16 (FIG. 6). Two first side receptacles 20 and 19 receive the ends of the lower chord 6 and upper element 5 respectively of truss 37. Two second side receptacles 22 and 21 spaced apart by extension 23 connect to the lower chord 13 and upper element 12 of truss 11 respectively that is orthogonal to sloping truss 37 and that has upper element and lower chord that are spaced apart and parallel to one another. Each corner connector 16 has a downwardly directed lower receptacle 18 for receiving corner post 17.

When a truss 37 is between two adjacent trusses 37, the 2-way connector 31 is replaced by 3-way connector 40 (FIG. 9) with three pairs of in-line receptacles 41, 42, and 43 that are orthogonal to each other, and each corner connector 16 is replaced by a two-truss connectors 36 (FIG. 8) at each end of the truss. Each two-truss connector 36 has a pair of first side receptacles 38 for the upper element 5 and the lower chord 6 of the truss 37 and two spaced-apart pairs of second side in-line receptacles 39 for the upper elements 12, and the lower chord 13 of truss 11. The first side receptacles lie in a first common plane and the second side receptacles lie in a second common plane orthogonal to the first plane.

H connector 10 (FIG. 3) has in-line receptacles 14 for receiving upper element 12 and in-line receptacles 15 for receiving lower chord 13 respectively of truss 11 to maintain their spacing apart to stiffen truss 11.

T connector 24 (FIG. 4) has two in-line receptacles 25 that receive an elongate cylindrical element 2 such as the upper sloping element of truss 37 (FIG. 1) and an angularly adjustable side receptacle 26 pivoting about a pivot 44. All of the receptacles of 24 lie in a common plane.

Cross connector 28 (FIG. 5) has in-line receptacles 29 and two angularly adjustable side receptacles 30 pivoting about pivots 45. All of the receptacles of connector 28 lie in a common plane. The cross connector 28 cooperates with two T-connectors 24 to connect stiffening element 2 between two points on the upper element 5 and the vertical stiffening element that connects the peak to the lower chord of truss 37.

Referring now to FIG. 11, a frame is constructed with only two sloping trusses 37 with T connectors 24 on the upper element 5 connecting to T connectors 24 on the lower chord 6.

Figure 12:
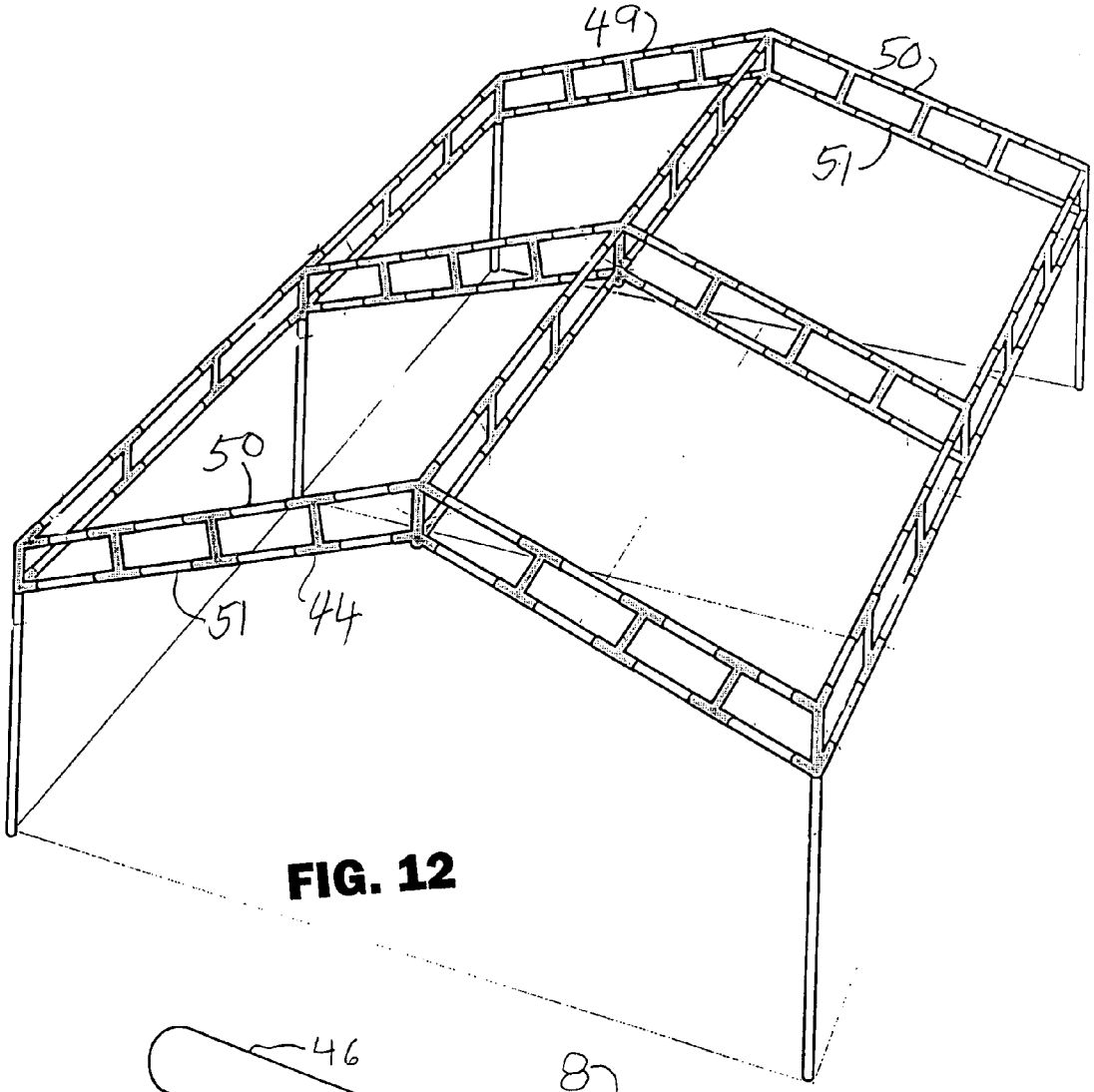
FIG. 12 is a perspective diagrammatic view of another embodiment of the invention.
Figure 10:
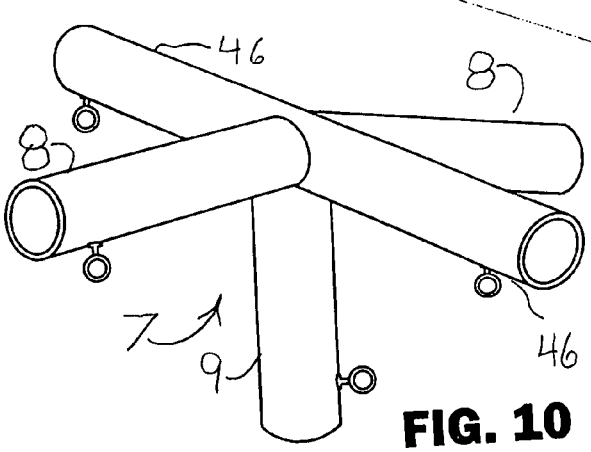
FIG. 10 is a perspective view of a peak connector of the invention.

Referring now to FIG. 12, a frame is constructed with sloping trusses 49 with lower chord 51 parallel to upper element 50.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. In a frame of elongate rigid cylindrical elements joined together for supporting a fabric canopy or tent, the improvement comprising:

a plurality of connectors having at least three tubular receptacles for receiving the elongate rigid cylindrical elements, the connectors having special configurations for forming, in cooperation with the cylindrical elements, a frame having;

a) a plurality of spaced-apart vertical support posts;

b) a plurality of interconnected trusses supported by said spaced-apart vertical support posts, each truss having an upper element for supporting contact with the fabric underside and a lower chord, with at least one stiffening member connected between the lower chord and the upper element at sites intermediate the spaced-apart vertical support posts for enhancing the rigidity of the trusses to allow for greater distance between the vertical support posts; and c) four corner connectors that receive four of the vertical support posts, and that also join together trusses that are at right angles to each other.

2. The improvement according to claim 1 in which each corner connector has a lower receptacle for a vertical support post; two first side receptacles; one above the other, for the upper element and lower chord respectively of a first truss; and two second side receptacles, orthogonal to the first side receptacles, one above the other, for the upper element and lower chord respectively of a second truss.

3. The improvement according to claim 2 in which each receptacle of each connector is provided with a threaded transverse aperture for receiving a threaded locking device.

4. The improvement according to claim 3 further comprising at least one H connector with two pairs of receptacles, one spaced above the other, the receptacles in each pair in line with one another and the four receptacles lying in a common plane for stiffening a truss with parallel upper element and bottom chord.

5. The improvement according to claim 4 in which there are two sets of trusses, a first set of trusses in which the upper element is straight and parallel to the bottom chord, and a second set of trusses orthogonal to the first set in which the upper element is formed of two sloping members received in angularly disposed receptacles of a peak connector and the bottom chord is parallel to the upper element.

6. The improvement according to claim 1 in which there are two sets of trusses, a first set of trusses in which the upper element is straight and parallel to the bottom chord, and a second set of trusses orthogonal to the first set in which the upper element is formed of two sloping members received in angularly disposed receptacles of a peak connector at an obtuse angle at a peak, the peak connector provided with a downwardly directed receptacle, the angularly disposed receptacles and the downwardly directed receptacle lying in a common plane, and at least one lateral receptacle directed orthogonal to the common plane.

7. The improvement according to claim 6 further comprising at least one T connector having two in-line rigid receptacles and a side receptacle that is angularly adjustable, all of the receptacles lying in a common plane.

8. The improvement according to claim 7 further comprising at least one cross connector having two in-line rigid receptacles and two angularly adjustable side connectors, all of the receptacles lying in a common plane.

9. The improvement according to claim 8 further comprising at least one 2-way connector having one pair of in-line rigid receptacles and two side receptacles, the side receptacles orthogonal to one another and lying in a common plane orthogonal to the pair of in-line receptacles.

10. The improvement according to claim 9 further comprising at least one two-truss connector for joining two trusses together at right angles, the two-truss connector having two first side receptacles lying in a first common plane; one above the other, for the upper element and lower chord respectively of a first truss, and two pairs of second side receptacles lying in a second common plane, orthogonal to the first common plane, for the upper element and lower chord of a second truss.

11. The improvement according to claim 10 further comprising at least one 3-way connector having three pairs of in-line rigid receptacles, each pair at right angles to the other two pairs.

12. In a frame having spaced-apart vertical support posts for supporting a fabric canopy or tent, the frame comprised of elongate rigid cylindrical elements joined together by a plurality of connectors forming a plurality of interconnected trusses, each truss having an upper element for supporting contact with the fabric underside and a lower chord, with at least one stiffening member connected between the lower chord and the upper element at sites intermediate said spaced apart vertical support posts for enhancing the rigidity of the trusses to enable greater distance between said vertical support posts, the improvement comprising:

a) a plurality of connectors each having at least three tubular receptacles for receiving the elongate rigid cylindrical elements, the connectors having special configurations for forming the frame in cooperation with the cylindrical elements, the connectors including;

b) four corner connectors that receive the corner posts and that also join together trusses that are at right angles to each other; each corner connector having a lower receptacle for the vertical corner post; two first side receptacles; one above the other, for the upper element and lower chord respectively of a first truss; and two second side receptacles, orthogonal to the first side receptacles, one above the other, for the upper element and lower chord respectively of a second truss;

c) at least one H connector with two pairs of receptacles, one spaced above the other, the receptacles in each pair in line with one another and the four receptacles lying in a common plane for stiffening a truss with parallel upper element and bottom chord;

d) a peak connector for a truss in which the upper element is formed of two sloping elongate members, angularly disposed receptacles in the peak connector for receiving the sloping members at an obtuse angle, the peak connector provided with a downwardly directed receptacle, the angularly disposed receptacles and the downwardly directed receptacle lying in a common plane, and at least one lateral receptacle directed orthogonal to the common plane;

e) at least one T connector having two in-line rigid receptacles and a side receptacle that is angularly adjustable, all of the receptacles lying in a common plane;

f) at least one cross connector having two in-line rigid receptacles and two angularly adjustable side connectors, all of the receptacles lying in a common plane; and g) at least one 2-way connector having one pair of in-line rigid receptacles and two side receptacles, the side receptacles orthogonal to one another and lying in a common plane orthogonal to the pair of in-line receptacles.

13. The improvement according to claim 12 further comprising at least one two-truss connector for joining two trusses together at right angles, the two-truss connector having two first side receptacles lying in a first common plane; one above the other, for the upper element and lower chord respectively of a first truss; and two pairs of second side receptacles lying in a second common plane, orthogonal to the first common plane for the upper element and lower chord of a second truss.

14. The improvement according to claim 13 further comprising at least one 3-way connector having three pairs of in-line rigid receptacles, each pair at right angles to the other two pairs.

15. The improvement according to claim 14 in which each receptacle of each connector is provided with a threaded transverse aperture for receiving a threaded locking device.

16. The improvement according to claim 14 in which the threaded locking device is an eyebolt.

17. The improvement according to claim 12 in which each receptacle of each connector is provided with a threaded transverse aperture for receiving a threaded locking device.

* * * * *